US007727123B2

(12) United States Patent
Stout et al.

(10) Patent No.: US 7,727,123 B2
(45) Date of Patent: Jun. 1, 2010

(54) AQUATIC EXERCISE DEVICE

(75) Inventors: Tadlinton A. Stout, Santa Barbara, CA (US); James P. Cleary, San Diego, CA (US)

(73) Assignee: Aqualogix, Inc., San Diego, CA (US)

( * ) Notice: Subject to any disclaimer, the term of this patent is extended or adjusted under 35 U.S.C. 154(b) by 0 days.

(21) Appl. No.: 11/803,711

(22) Filed: May 14, 2007

(65) Prior Publication Data

US 2008/0058179 A1 Mar. 6, 2008

Related U.S. Application Data

(60) Provisional application No. 60/800,091, filed on May 12, 2006.

(51) Int. Cl.
*A63B 31/00* (2006.01)

(52) U.S. Cl. ..... 482/55; 482/111; D21/676

(58) Field of Classification Search ..... 482/55, 482/111, 139, 92–93, 38, 44, 56, 108, 51; D21/678, 789, 807; 473/612–615; 472/128; 441/56, 58, 136

See application file for complete search history.

(56) References Cited

U.S. PATENT DOCUMENTS

| | | | | | |
|---|---|---|---|---|---|
| 2,941,219 | A * | 6/1960 | Irving | 441/56 |
| 3,047,302 | A * | 7/1962 | Krylov | 280/810 |
| 3,052,897 | A * | 9/1962 | Martin | 441/56 |
| 3,109,186 | A * | 11/1963 | Glenn | 441/60 |
| 3,407,419 | A * | 10/1968 | Drummond | 441/56 |
| 3,411,166 | A * | 11/1968 | Kimmel | 441/65 |
| 3,610,615 | A * | 10/1971 | Clearly | 472/69 |
| 4,603,854 | A * | 8/1986 | Krausz | 482/111 |
| 4,623,142 | A * | 11/1986 | MacKechnie | 482/111 |
| 4,632,387 | A * | 12/1986 | Guzman | 482/111 |
| 4,902,005 | A * | 2/1990 | McNeill | 482/93 |
| 5,184,993 | A * | 2/1993 | Dowdeswell | 482/106 |
| 5,531,657 | A * | 7/1996 | Macedo | 482/111 |
| 5,842,957 | A * | 12/1998 | Wheeler | 482/111 |
| 5,851,132 | A * | 12/1998 | Merrill | 440/101 |
| 6,142,843 | A * | 11/2000 | Haase | 441/129 |
| 6,325,727 | B1 * | 12/2001 | Carr | 473/228 |
| 6,709,306 | B2 * | 3/2004 | Brown | 441/56 |
| 7,090,618 | B2 * | 8/2006 | Stout et al. | 482/55 |
| 7,124,702 | B1 * | 10/2006 | Cameron | 114/352 |
| 7,211,032 | B2 * | 5/2007 | Shifferaw | 482/111 |
| 2009/0114138 | A1 * | 5/2009 | Pritchard et al. | 114/249 |

* cited by examiner

*Primary Examiner*—Lori Baker
(74) *Attorney, Agent, or Firm*—Mintz, Levin, Cohn, Ferris, Glovsky and Popeo, P.C.

(57) ABSTRACT

An aquatic exercise device is adapted to be submerged in water, and moved through the water and/or rotated in the water to provide omni-directional and omni-rotational drag resistance. In one implementation, an aquatic exercise device includes a bar adapted to be grasped by one or two hands of a user, and a resistance mechanism attached to opposite ends of the bar. Each resistance mechanism includes a cuff and two or more fins extending outward from the cuff.

8 Claims, 1 Drawing Sheet

AQUATIC EXERCISE DEVICE

CROSS REFERENCE TO RELATED APPLICATION

The present patent application claims priority under 35 U.S.C. §119 to U.S. Provisional Patent Application Ser. No. 60/800,091, filed on May 12, 2006, and entitled, "AQUATIC EXERCISE DEVICE", the entire disclosure of which is incorporated by reference herein.

BACKGROUND

The following description relates in general to physical exercise and physical therapy, and more specifically to an apparatus and method for exercise and physical therapy in water.

Aquatic physical exercise has been found to be one of the best forms of exercise. Water supports an individual's body and alleviates most of the effects of gravity allowing the individual to exercise prescribed specific muscle groups without stressing other areas of the body. The reduced physical strain on these other area allows the individual to exercise for longer periods of time. The individual is also able to exercise longer due to a lower and more stabilized body temperature resulting from contact with the water. Strain on the heart, muscles and ligaments is minimized while the benefits of physical activity are maximized.

Accordingly, aquatics-based physical therapy is most noticeably gaining popular with the elderly, the obese, and the infirm, but still finds demand from people of all ranges of fitness and exercise regiment. There is a huge demand for an exercise modality which provides long-term health benefits and which can exist in the favorable environment of lower stress and freer movement. Conventional aquatic exercise devices and methods, however, are limited in several ways. For example, conventional devices do not offer uniform resistance when moved through the water. As a result, the devices feel awkward and unstable to the user. In addition, conventional aquatic devices include a single handle connected in an orientation that prohibits certain exercise motions. Further, conventional aquatic exercise devices do not provide the appropriate resistance training for enhancing performance in sporting activities. Conventional aquatic exercise devices, for example, do not target muscle groups for specific sports or activities such as golf, baseball, kayaking, or other activities that utilize a hand-held device such as, for example, a racket, bat, paddle, or club.

Therefore, there exists a need for an aquatic exercise device and method that provide uniform resistance for an increased range and variety of motions.

SUMMARY

This document discloses a core training device embodied as an aquatic exercise device that efficiently and effectively works a large range of muscles, in particular abdominal, side and back muscles, by providing uniform and multi-directional drag resistance.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
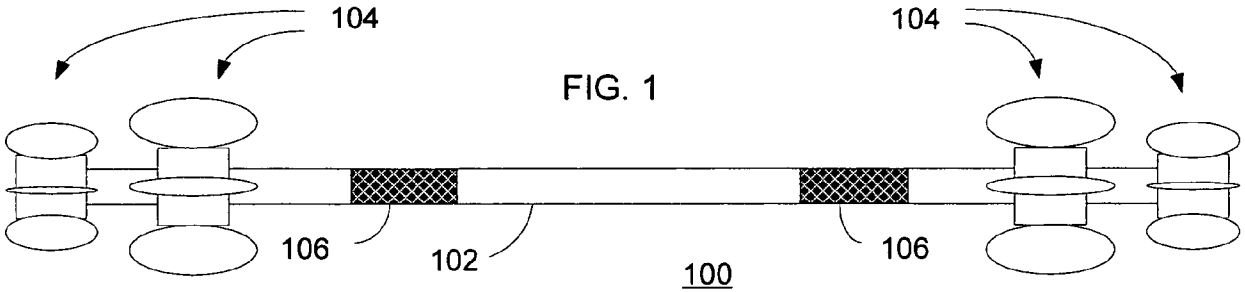
FIG. 1 depicts a barbell embodiment of an aquatic exercise device.

FIG. 1 illustrates an aquatic exercise device 100, embodied as a barbell, and having a bar 102 and resistance mechanisms 104 attached to opposite ends of the bar 102. Each resistance mechanism can include a cuff, and two or more fins connected to and extending outward from the cuff. Preferably, the two or more fins are arranged around the cuff at measured and regular spaces, such that fins provide uniform and symmetrical resistance regardless of orientation of the bar 102. Each fin can include a main vertical fin, and one or more horizontal fins for cross-wise resistance (i.e. in the axis that is parallel to the axis of the bar). Each fin can be rounded or squared. In some embodiments, one or more of the fins are detachable, and include a mounting mechanism attached to the cuff, for easy attaching and detaching for configurable levels of resistance. One example of the cuff and fins is described in U.S. patent application Ser. No. 11/413,645, the contents of which are incorporated by reference herein for all purposes.

The bar can include one or more handgrips 106. The handgrips 106 can be adapted to conform to a human hand's gripping action, or may simply be marked as an area that should be grasped by a user's hands for effective use. The bar can be formed of a rigid material, such as plastic, nylon, or composite fiber material, or of a semi-rigid or flexible material. The bar can be cylindrical or any other cross-sectional shape.

In some embodiments, each resistance mechanism 104 is detachable, such that one or more resistance mechanisms 104 can be stacked on each end of the bar (as show in FIG. 1). Accordingly, a configurable amount of resistance can be provided depending on the number and size of the fins and/or resistance mechanisms 104 used. The cuff of the resistance mechanism 104 can be integrated with the bar, and/or can be rigid, semi-rigid or flexible. In one example, the cuff is formed of nylon and neoprene. The fins can be formed of plastic, metal, carbon fiber or other composite material, or the like.

Figure 2:
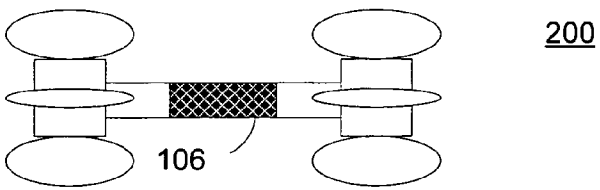
FIG. 2 depicts a hand bell embodiment of an aquatic exercise device.

FIG. 2 depicts a handbell embodiment of an aquatic exercise device 200. The aquatic exercise device 200 includes a bar and at least one resistance mechanism attached to an end of the bar. Preferably, a resistance mechanism is attached to opposite ends of the bar. The resistance mechanisms can be formed substantially as described above.

Figure 3:
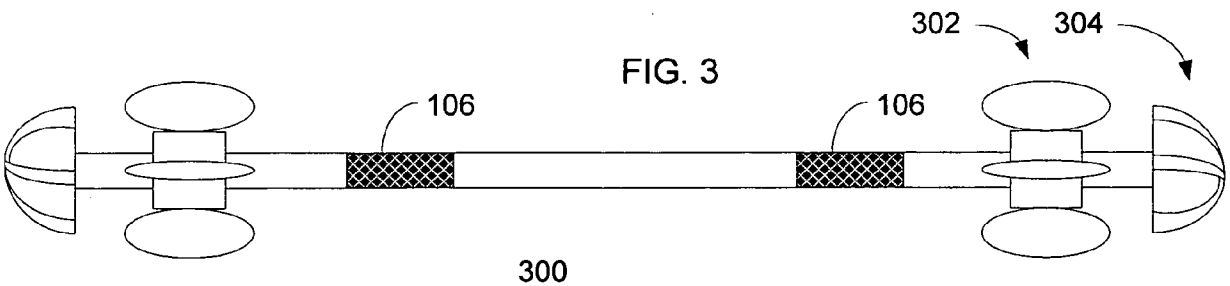
FIG. 3 shows a variant of a barbell embodiment of an aquatic exercise device.

FIG. 3 depicts an alternative embodiment of an aquatic exercise device 300, that includes one or more resistance mechanisms that are detachably connected to opposite ends of a bar. The resistance mechanisms can include a cuff and fins arrangement 302, substantially as described above, and/or a dome-shaped bell 304, substantially as described in U.S. Pat. Nos. 6,672,993, 6,955,633 and 6,962,553, the contents of which are incorporated by reference herein for all purposes.

In use, the aquatic exercise device illustrated in FIGS. 1-3 can be grasped by one or both hands of a user, submerged in water, and then moved through the water to provide drag resistance to the user. The aquatic exercise device can be moved in a direction, and/or any rotational movement. In preferred embodiments, the type and number of resistance mechanisms provide uniform, measured and configurable resistance in any direction or rotational orientation.

Although a few embodiments have been described in detail above, other modifications are possible. Other embodiments may be within the scope of the following claims.

What is claimed:

1. An aquatic exercise device comprising:

a bar adapted to be grasped by one or two hands of a user; and a resistance mechanism attached to opposite ends of the bar, each resistance mechanism including:

a cuff having two or more fins extending outward from the cuff equally spaced around the bar, for providing uniform omni-directional fluid resistance to forward-and-back motion of the device; and a dome shaped bell coupled to a distal end of the bar through an open end of the dome shaped bell, for providing uniform fluid resistance to side-to-side motion of the device.

2. An aquatic exercise device in accordance with claim 1 wherein the dome-shaped bell includes two or more fins symmetrically arranged about the dome-shaped bell.

3. An aquatic exercise device in accordance with claim 1, wherein the bar is between 12 inches and 60 inches in length.

4. An aquatic exercise device comprising:

a rigid bar adapted to be grasped by one or two hands of a user, the bar having a length of between 12 and 60 inches and having two opposed ends; and a resistance mechanism attached to each opposed end of the rigid bar, each resistance mechanism including:

three or more fins arranged symmetrically around an axis defined by the rigid bar, and for providing uniform resistance against water when the rigid bar is moved forward and backward through the water by the user; and a dome shaped bell coupled to a distal end of the bar through an open end of the dome shaped bell, for providing uniform fluid resistance to side-to-side motion of the device.

5. An aquatic exercise device in accordance with claim 4, wherein the resistance mechanism further includes a cuff connected to each end of the rigid bar, each cuff being connected to and aligning the three or more fins.

6. An aquatic exercise device in accordance with claim 5, wherein the fins are rounded.

7. An aquatic exercise device in accordance with claim 4, wherein each end of the rigid bar is adapted to receive one or more additional resistance mechanisms stacked on the end of the bar.

8. An aquatic exercise device in accordance with claim 4, wherein the rigid bar is a handbell adapted to be grasped by one hand of the user.

* * * * *

UNITED STATES PATENT AND TRADEMARK OFFICE

CERTIFICATE OF CORRECTION

PATENT NO. : 7,727,123 B2
APPLICATION NO. : 11/803711
DATED : June 1, 2010
INVENTOR(S) : Tadlington A. Stout et al.

It is certified that error appears in the above-identified patent and that said Letters Patent is hereby corrected as shown below:

On the Title page, item [75] 1st inventor should read

-- Tadlington A. Stout --.

Signed and Sealed this

Second Day of November, 2010

David J. Kappos

David J. Kappos
*Director of the United States Patent and Trademark Office*